US012753679B2

(12) United States Patent
Stam

(10) Patent No.: US 12,753,679 B2
(45) Date of Patent: Oct. 6, 2026

(54) METHOD OF CREATING AN ANNULAR ZONAL ISOLATION SEAL IN A DOWNHOLE ANNULUS

(71) Applicant: SHELL USA, INC., Houston, TX (US)

(72) Inventor: Walter Stam, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 107 days.

(21) Appl. No.: 18/247,895

(22) PCT Filed: Oct. 4, 2021

(86) PCT No.: PCT/EP2021/077282
§ 371 (c)(1),
(2) Date: Apr. 5, 2023

(87) PCT Pub. No.: WO2022/078800
PCT Pub. Date: Apr. 21, 2022

(65) Prior Publication Data

US 2023/0399925 A1 Dec. 14, 2023

(30) Foreign Application Priority Data

Oct. 12, 2020 (EP) ..... 20201362
Mar. 17, 2021 (EP) ..... 21163090
(Continued)

(51) Int. Cl.
*E21B 43/10* (2006.01)
*E21B 23/03* (2006.01)
(Continued)

(52) U.S. Cl.
CPC ..... *E21B 43/105* (2013.01); *E21B 23/03* (2013.01); *E21B 23/0414* (2020.05);
(Continued)

(58) Field of Classification Search
CPC ..... E21B 43/105; E21B 3/1208; E21B 43/106
See application file for complete search history.

(56) References Cited

U.S. PATENT DOCUMENTS 6,745,846 B1 * 6/2004 Innes ..... E21B 43/105 166/387
9,757,796 B2 9/2017 Sherman et al.
(Continued)

FOREIGN PATENT DOCUMENTS

WO 2013012931 A2 1/2013
WO 2019151870 A1 8/2019

OTHER PUBLICATIONS

International Search Report and Written Opinion Received for PCT Patent Application No. PCT/EP2021/077282, Mailed on Dec. 20, 2021, 12 Pages.
(Continued)

*Primary Examiner* — Theodore N Yao
(74) *Attorney, Agent, or Firm* — SHELL USA, INC.

(57) ABSTRACT

An isolation joint is provided with a downhole tubular that has an expandable section which, in axial direction, is sandwiched between a first separator section and a second separator section of the downhole tubular. The expandable section has a circumferential band of increased wall thickness compared to the wall thicknesses of the first and second separator sections. Furthermore, the downhole tubular is provided with a mating support at a predetermined axial location relative to said at least expandable section, adapted for mating with the local expander device within said downhole tubular. This mating support ensures transversal alignment with of a local expander device with the downhole tubular such that the local expansion exclusively is activated within the expandable section.

12 Claims, 8 Drawing Sheets

(30) Foreign Application Priority Data

Sep. 7, 2021 (EP) ..... 21195314
Sep. 9, 2021 (EP) ..... 21195665

(51) Int. Cl.
*E21B 23/04* (2006.01)
*E21B 33/12* (2006.01)

(52) U.S. Cl.
CPC ..... *E21B 33/1208* (2013.01); *E21B 43/106* (2013.01); *E21B 2200/08* (2020.05)

(56) References Cited

U.S. PATENT DOCUMENTS 9,903,010 B2 2/2018 Doud et al.
10,150,713 B2 12/2018 Doud et al.
10,794,158 B2 10/2020 Cornelissen
11,002,097 B2 5/2021 Rairigh
11,015,410 B2 5/2021 Rairigh
11,377,927 B2 7/2022 Ruckert
2006/0065408 A1* 3/2006 Green ..... E21B 43/108 166/207
2009/0139732 A1 6/2009 Garcia
2011/0094753 A1* 4/2011 Whiddon ..... E21B 17/06 166/207
2012/0205872 A1* 8/2012 Reinhardt ..... E21B 43/103 277/336
2014/0000911 A1 1/2014 Gorrara et al.
2014/0151046 A1 6/2014 Marya et al.
2014/0196914 A1* 7/2014 Ring ..... E21B 33/124 166/387
2017/0226828 A1* 8/2017 Brisco ..... E21B 43/103
2018/0187524 A1* 7/2018 Yee ..... E21B 43/106
2021/0102434 A1* 4/2021 Rairigh ..... F42C 19/0807
2021/0108478 A1* 4/2021 Filippov ..... E21B 29/10
2021/0254423 A1 8/2021 Rairigh
2021/0254429 A1 8/2021 Ruckert et al.

OTHER PUBLICATIONS

"HydraKratos Product Report", HydraWell—One Invention Ahead, 2015, 1 Page.
"TervAlloy 3241", Terves—Engineered Responses, 2020, 2 Pages.
"WearSox Product Overview", Innovex, 2020, 6 Pages.
"Multi-layer Composite Centralizer", Innovex, 2020, 5 Pages.

* cited by examiner

METHOD OF CREATING AN ANNULAR ZONAL ISOLATION SEAL IN A DOWNHOLE ANNULUS

CROSS REFERENCE TO RELATED APPLICATIONS

This is a National stage application of International Application No. PCT/EP2021/077282, filed 4 Oct. 2021, which claims priority of European Procedure Application No. 20201362.9, filed 12 Oct. 2020, European Procedure Application No. 21163090.0, filed 17 Mar. 2021, European Procedure Application No. 21195314.6, filed 7 Sep. 2021 and European Procedure Application No. 21195665.1, filed 9 Sep. 2021 which is incorporated herein by reference in its entirety.

FIELD OF THE INVENTION

The present invention relates to a method of creating an annular zonal isolation seal in a downhole annulus. In other aspects, the invention relates to an isolation joint for downhole use in a borehole in the Earth; a local expander device for locally expanding a downhole tubular; and/or a combination of such an isolation joint and local expander device, for locally expanding the downhole tubular.

BACKGROUND TO THE INVENTION

WO 2019/151870 A1 discloses a method and system of forming a cross-sectional sealing plug in a subterranean well, which can be used for zonal isolation. In this method, a pipe expansion device is lowered into an innermost pipe body, which is configured in the well, to a first location in the well. A first section of the pipe body is expanded with the pipe expansion device, until an outside of the pipe body contacts a surrounding wellbore wall. Thus, an expanded pipe section is formed which is capable of closing the at least one annulus (fully or partially). Sometimes, cracks may form in the expanded pipe section during expansion of the pipe body. For certain applications, such cracks are undesired.

SUMMARY OF THE INVENTION

In accordance with one aspect of the present invention, there is provided a method of creating an annular zonal isolation seal in a downhole annulus between a string of downhole tubular joints inserted within a bore in borehole in the Earth, and an inner wall of the bore, comprising:

including an isolation joint in the string, said isolation joint comprising a downhole tubular of a predetermined length in an axial direction, comprising a tube wall having a wall thickness that varies in the axial direction over said length, whereby at least one expandable section is provided in the downhole tubular which, in axial direction, is sandwiched between a first separator section and a second separator section of the downhole tubular, wherein said at least one expandable section has a circumferential band of increased wall thickness compared to the wall thicknesses of the first and second separator sections, and said downhole tubular further providing a mating support at a predetermined axial location relative to said at least expandable section, adapted for mating with a local expander device within said downhole tubular;

providing a local expander device comprising:

a force imparting section configured to impart a transversely directed expansion force to an expandable section of the downhole tubular, and a carrier section, carrying the force imparting section, and comprising a complementary mating support at a predetermined axial separation distance relative to the force imparting section;

lowering said local expander device through the downhole tubular string and at least partially into the isolation joint;

mating the local expander device in position by engaging the complementary mating support with said mating support of the downhole tubular whereby the force imparting section of the local expander device is in transverse alignment with said circumferential band of increased wall thickness in the expandable section of the downhole tubular;

activating the force imparting section of the local expander device, thereby imparting the transversely directed expansion force to the expandable section of the downhole tubular whereby locally expanding the downhole tubular into the downhole annulus.

In further aspects, the present invention provides one or more of the following:

An isolation joint for downhole use in a borehole in the Earth, comprising a downhole tubular of a predetermined length in an axial direction, comprising a tube wall having a wall thickness that varies in the axial direction over said length, whereby at least one expandable section is provided in the downhole tubular which, in axial direction, is sandwiched between a first separator section and a second separator section of the downhole tubular, wherein said at least one expandable section has a circumferential band of increased wall thickness compared to the wall thicknesses of the first and second separator sections, and said downhole tubular further providing a mating support at a predetermined axial location relative to said at least expandable section, adapted for mating with a local expander device within said downhole tubular in a transversal alignment with said circumferential band.

A local expander device for locally expanding a downhole tubular, said local expander device comprising:

a force imparting section configured to impart a transversely directed expansion force to an expandable section of the downhole tubular, and a carrier section, carrying the force imparting section, and comprising a complementary mating support at a predetermined axial separation distance relative to the force imparting section, for selectively engaging with a mating support provided in the downhole tubular to force the local expander device into a fixed axial position within the downhole tubular.

A combination of such an isolation joint and such a local expander device as, for locally expanding the downhole tubular.

BRIEF DESCRIPTION OF THE DRAWINGS

The drawing figures depict one or more implementations in accordance with the present teachings, by way of example only, not by way of limitation. In the figures, like reference numerals refer to the same or similar elements.

DETAILED DESCRIPTION OF THE INVENTION

Figure 1:
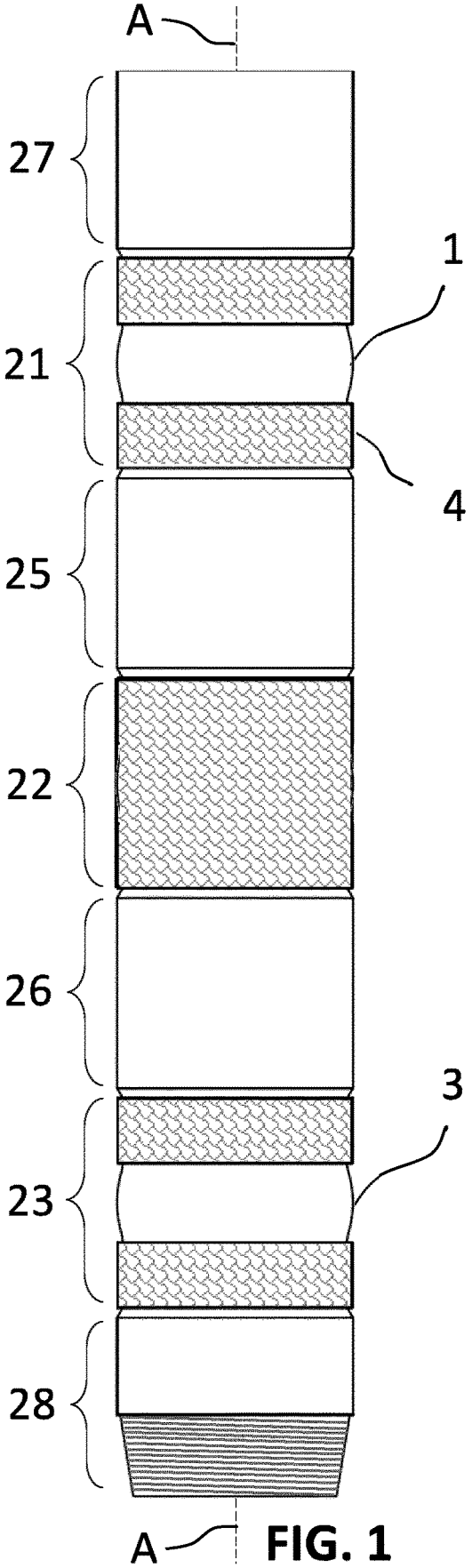
FIG. 1 schematically shows a side view of an example isolation joint.

The person skilled in the art will readily understand that, while the detailed description of the invention will be illustrated making reference to one or more embodiments, each having specific combinations of features and measures, many of those features and measures can be equally or similarly applied independently in other embodiments or combinations.

The present invention relates to locally expanding a downhole tubular with a local expander device. Such a local expander device generally is held at one axial location (depth) within a string of downhole tubulars, while radially expanding an expandable section in the string. As described herein, it is presently proposed to employ an isolation joint comprising a downhole tubular of a predetermined length in an axial direction, comprising a tube wall having a wall thickness that varies in the axial direction over said length, whereby at least one expandable section is provided in the downhole tubular which, in axial direction, is sandwiched between a first separator section and a second separator section of the downhole tubular. The expandable section has a circumferential band of increased wall thickness compared to the wall thicknesses of the first and second separator sections. This allows for accommodating a wall-thinning effect which accompanies locally radially expanding of the downhole tubular in said expandable section. The circumferential band of increased wall thickness can be selected such that sufficient wall thickness is maintained throughout the local expansion to, preferably not only avoid rupture, but also to maintain pressure rating in the expandable section that is not lower than the pressure rating of the entire tubular string. Preferably, the wall thickness has a maximum at the axial location where, after the radial expansion has been completed, the tubular wall will have the largest outer diameter.

It will be clear to the skilled person, that the local expander device imparts a radial strain on the isolation joint exclusively within the or each circumferential band of increased wall thickness. In other words, the banks of increased wall thickness extend over a sufficient amount of length in the axial direction to take all of the radial imparted strain from the local expander device within a single band of increased wall thickness. The applied radial strain may exceed the elastic limit of the material from which the isolation joint tubular wall is made.

Furthermore, the downhole tubular is provided with a mating support at a predetermined axial location relative to said at least expandable section, adapted for mating with the local expander device within said downhole tubular. This mating support ensures transversal alignment with of the local expander device with the downhole tubular such that the local expansion exclusively is activated within the expandable section and within a single band of increased wall thickness.

To this end, the local expander device preferably comprises a force imparting section configured to impart a transversely directed expansion force to an expandable section of the downhole tubular; and a carrier section, carrying the force imparting section, and comprising a complementary mating support at a predetermined axial separation distance relative to the force imparting section, for selectively engaging with the mating support provided in the downhole tubular, to force the local expander device into a fixed axial position within the downhole tubular.

The mating support may furthermore impose axial alignment between the local expander device and the downhole tubular. Axial alignment, in this context, may equate to centralization of the force imparting section of the local expander device within the downhole tubular, which would facilitate concentric local expansion with a wall-thickness reduction that is constant around the circumference of the expandable section.

FIG. 1 schematically shows a side view of an example isolation joint. This isolation joint is specifically adapted to provide an annular zonal isolation seal in a downhole annulus between a string of downhole tubular joints inserted within a bore of borehole in the Earth, and an inner wall of the bore. The inner wall of the bore may be open Earth formation rock, for example to create zonal isolation against formation in an open hole configuration. In other embodiments, the inner wall of the bore may be the inner wall of a casing tubing.

The isolation joint is specifically adapted to be locally expanded by an expander that is inserted in the isolation joint and, during expansion, is maintained in a fixed axial position within the isolation joint. The isolation joint may be made up in a string of conventional wellbore tubulars, and cemented into place within a wellbore in the Earth. It may thus form part of a cemented tubular string, a liner hanger overlap, a liner hanger tie-back sealing arrangement, or placed as part of a cemented or open hole lower completion. The cement may be cured cement. The isolation joint of FIG. 1 comprises a downhole tubular extending in an axial direction A. The downhole tubular in this example comprises three expandable sections 21, 22, 23, but any suitable number of expandable sections may be configured. Each expandable section is sandwiched between separator sections. In the example of FIG. 1, a first expandable section 21 is sandwiched between separator sections 27 and 25; a second expandable section 22 is sandwiched between separator sections 25 and 26, and a third expandable section 23 is sandwiched between separator sections 26 and 28.

Each of the expandable sections may have a so-called "dent area". In FIG. 1, the first expandable section 21 comprises first dent area 1; the second expandable section 22 comprises second dent area 2, and the third expandable section 23 comprises third dent area 3. These dent areas may be embodied as circumferential bands of increased wall thickness compared to the wall thicknesses of the sandwiching separator sections. The locally thicker wall-thickness allows for wall-thinning which occurs during local radial expansion of the dent areas. This local thicker steel wall thus facilitates that sufficient wall-thickness is maintained post expansion ("denting"), to for example maintain the tubular pressure rating better than or equal to that of the tubular string.

In this specification the terms "band of increased wall thickness" and "dent area" are used interchangeably. The wall thickness may gradually increase and decrease (when contoured in axial direction) or the dent areas may comprise steps.

The amount of increase in wall thickness may be selected to accommodate a predetermined radial expansion target to which the band of increased wall thickness can be subjected without compromising post-expansion integrity of the wall in the dent section. In some cases, for example, a few %, e.g. 5%, increased wall thickness at the apex of these dent areas may already be sufficient. However, for a majority of the wellbore conditions in practice, the increased wall thickness generally at the apex of these dent areas, in the at least one expandable section, may be at least 15% thicker than the wall thicknesses of the sandwiching separator sections. Preferably, in the apex of these dent areas, the increased wall thickness is at least 25% thicker than the wall thicknesses of the sandwiching separator sections. Preferably, the increased wall thickness is never more than 40% thicker than the wall thickness of the sandwiching separator sections.

An elastomeric seal 4 may be configured arranged along a circumference on an outwardly facing side of the tube wall of the isolation joint. Preferably, the elastomeric seal 4 is arranged at least in the expandable section 21,22,23. The elastomeric seal 4 may preferably comprise a swellable material which swells when in direct contact with a wellbore fluid, such as water, brine, or a hydrocarbon fluid (oil or gas). Other examples of wellbore fluids with which some elastomeric seals may swell include $CO_2$ and hydrogen. An example of swellable elastomeric sleeves and how to apply them to a wellbore tubular is provided in US 2021/0254429 A1, which is incorporated herein by reference. The elastomeric seals may be located on flanks of the dent area on one or both sides of each dent area, such as shown in first and third expandable sections 21,23 in FIG. 1. Alternatively, the elastomeric seals may cover the complete denting interval of the expandable section, such as shown for example in the second expandable section 22. Besides sleeves, it would also be possible to place a packer type (thicker) of rubber over the dented interval. This would be an external casing packer application, possibly applicable to a cased hole sealing configuration as example.

Figure 2:
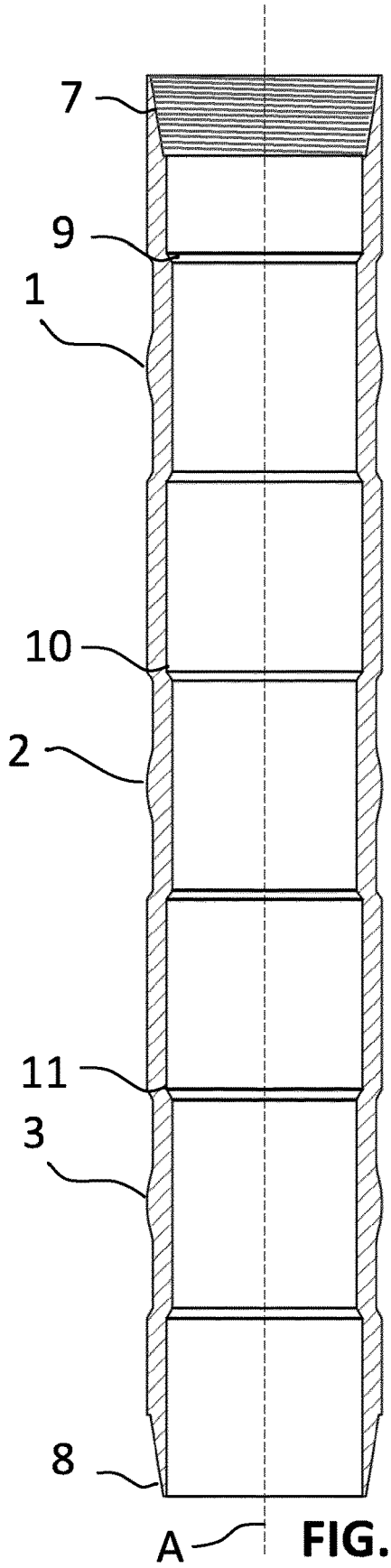
FIG. 2 schematically shows a cross-section of the isolation joint of FIG. 1.
Figure 10:
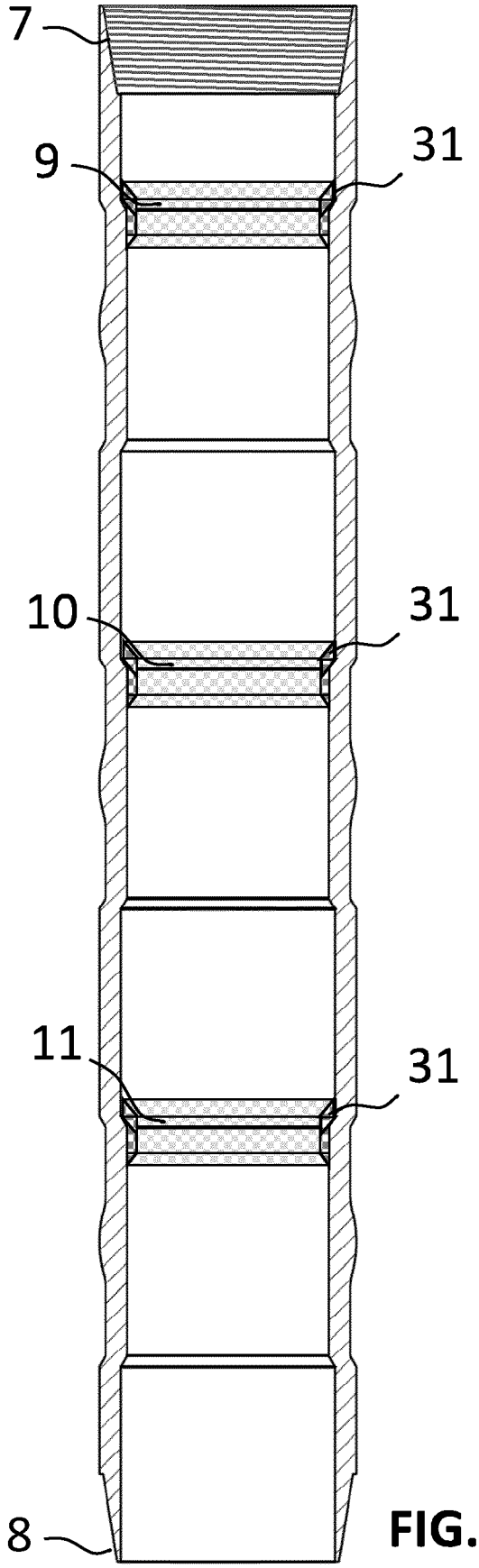

FIG. 2 schematically shows a cross-section of the steel parts of the isolation joint of FIG. 1. The isolation joint is conveniently provided with conventional pin 8 and box 7 connectors, which are compatible with connectors on the remaining string tubulars. For each dent area of the isolation joint, there is provided a landing shoulder 9, 10, 11, which functions as mating support to ensure an accurate placement of a local expander device relative to the dent area. This functionality will be further explained below, with reference to e.g. FIG. 4. The landing shoulders may each provide a landing surface that is inwardly protruding into the isolation joint. Other mating support designs may be employed if desired, such as recesses in which the local expander device can latch. Another example, which involves dissolvable elements (e.g. rings), will be discussed below with reference to FIG. 10. In any case, it is preferred that the mating support physically and mechanically supports the local expander device into position. The mating support may for instance incorporate a spring-loaded collet (dogs) to establish depth correlation. This as opposed to e.g. RF tags or other soft localizers which provide a location indicator but to not lock or mechanically support the local expander device into a fixed position. Each mating support is configured at a predetermined axial location relative to each expandable section, adapted for mating with the local expander device within the isolation joint. Each mating support is preferably located in a separator section, or any other suitable location that will not be subject to local radial expansion.

An advantage of employing an inwardly protruding landing shoulder in said mating support is that it will inherently also facilitate axial alignment of the local expander device on the longitudinal axis of the downhole tubular.

Figure 3:
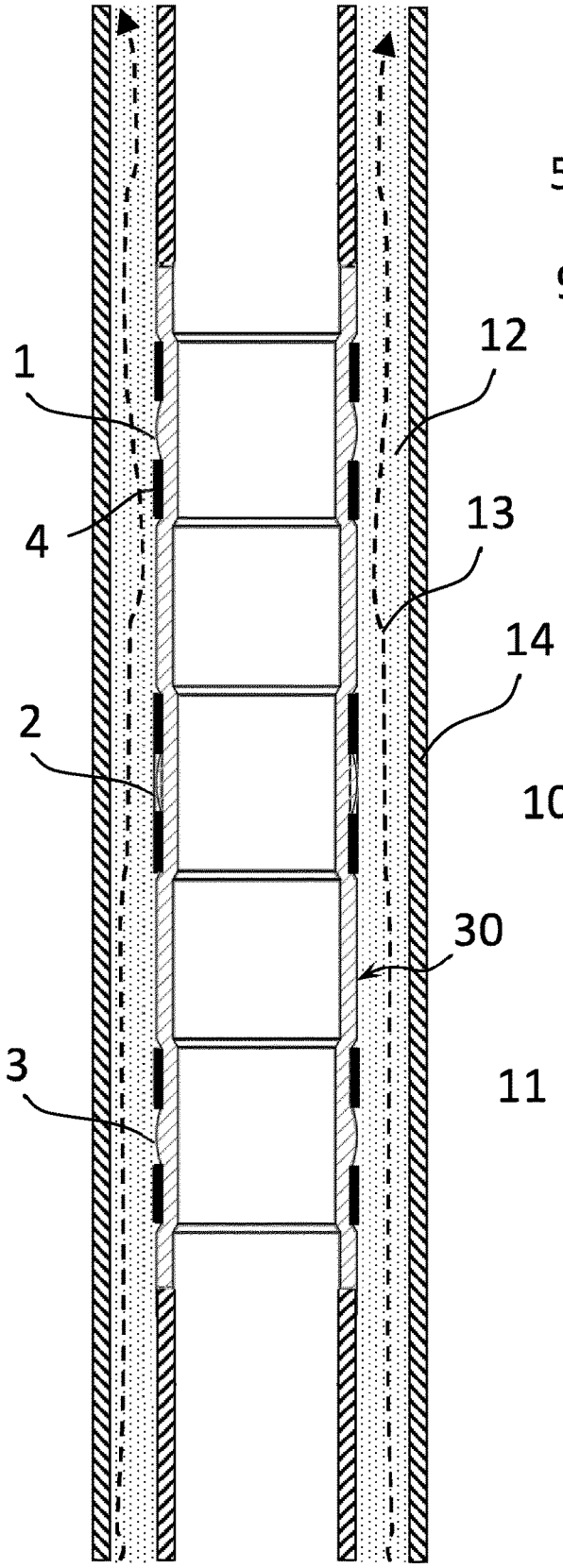
FIG. 3 schematically shows a cross-sectional view of another example of isolation joint, cemented in a cased wellbore.

FIG. 3 schematically shows the isolation joint 30 cemented into a wellbore, whereby a layer of cement 12 occupies the annulus defined around the isolation joint. When this isolation joint is cemented in place, the cement 12 may not create a perfect seal that prevents well fluid seepages 13 to surface. Typically, such seepages 13 may be seen after fracking operations, due to the ballooning of the casing well tubular, when internal tubular pressure, equal to frac pressures, is applied. This may cause formation of a micro annulus at the tubular-cement interface. De-bonding also may occur at an interface between cement 12 and an outer casing 14. In both cases the isolation joint can resolve the fluid seepage 13 by, means of radial expanding (or: denting) the joint in the expandable sections, and thereby densifying the confined cement behind the isolation joint. The general principle of using local expansion to densify and reset a cement sheath in an annulus has been disclosed in earlier publications, of which U.S. Pat. No. 10,794,158 and International publication WO 2020/016169 A1 are examples and incorporated by reference.

Figure 4:
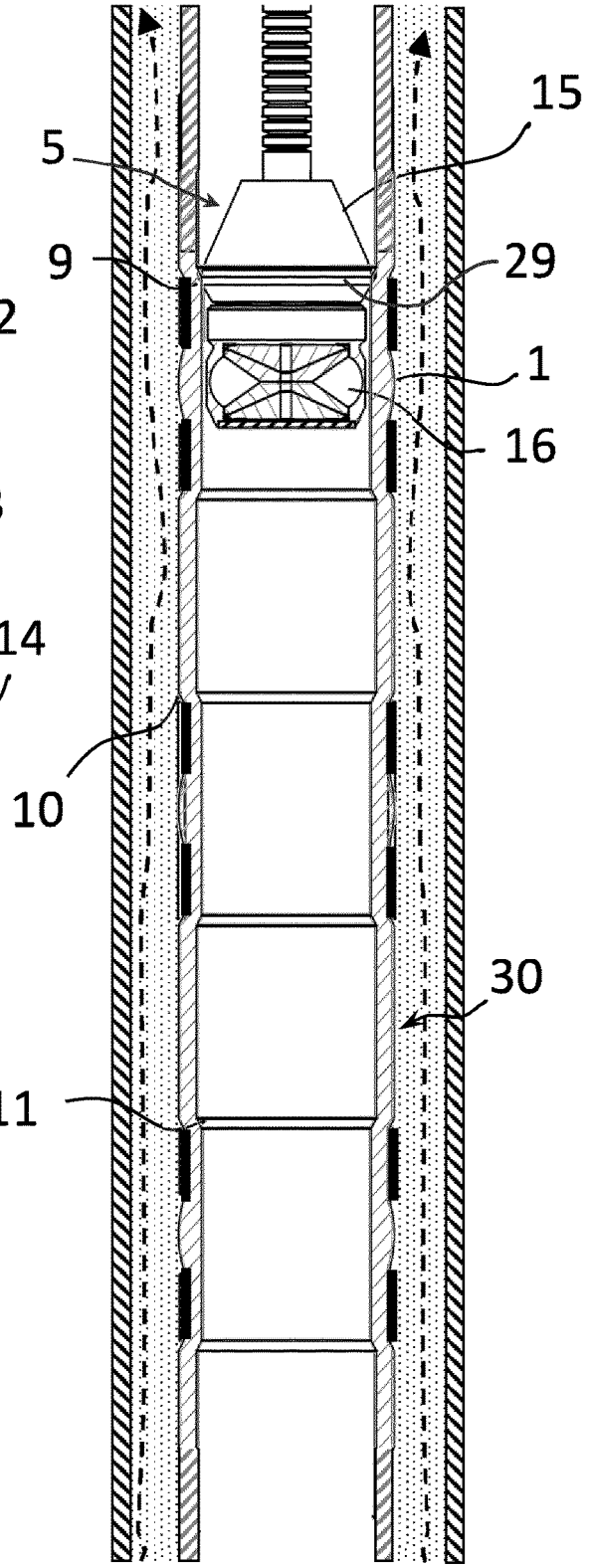
FIG. 4 schematically shows the cross-sectional view of the isolation joint of FIG. 4 with a single shot energetic expander landed in position.

To this end, FIG. 4 shows the isolation joint 30 of FIG. 3 with an expansion device 5 lowered into it. The expansion device 5 comprises a carrier section 15 and a force imparting section 16. The force imparting section 16 is configured to impart a transversely directed expansion force to the expandable section. The carrier section 15, which carries the force imparting section 16, comprising a complementary mating support 29 at a predetermined axial separation distance relative to the force imparting section 16. In the example as shown in FIG. 4, the outer diameter of the carrier section 15 exceeds the inner diameter of the isolation joint determined at the landing shoulder 9.

During operation, the local expander device 5 may be lowered through the downhole tubular string, and at least partially into the isolation joint as shown in e.g. FIG. 4. The local expander device 5 is then mated in position, by engaging the complementary mating support 29 of the local expander device 5 with the mating support 9 of the isolation joint, whereby the force imparting section 16 of the local expander device 5 is in transverse alignment with the circumferential band of increased wall thickness 1. The force imparting section 16 of the local expander device 5 can then be activated, thereby imparting the transversely directed expansion force accurately to the circumferential band of increased wall thickness 1.

Any suitable type of local expander device can be employed, including the local expander device as described in U.S. Pat. No. 10,794,158 or similar devices. Local expander devices may be run in any suitable manner, such as on wireline, slickline or coiled tubing. The example as illustrated in FIG. 4, employs an energetic expander device as for example proposed in International publication WO 2020/016169 A1.

Specific tool designs of energetic expanders are further disclosed in U.S. Pat. Nos. 11,015,410 and 11,002,097. These tools employ shaped charges to direct an explosive pressure wave transversely to the tool axis. Each explosive unit includes an explosive material formed adjacent to a backing plate and includes an exterior surface facing and being exposed to the inner surface of the housing. An aperture extends along the axis from one backing plate to the other backing plate. An explosive detonator is positioned along the axis adjacent to, and externally of, the one backing plate. The first and second explosive units comprise a predetermined amount of explosive sufficient to expand, without puncturing, at least a portion of the wall of the tubular into a protrusion extending outward into an annulus adjacent the wall of the tubular. The force imparting section is activated by detonating the explosive charges. After detonation, the explosive charges generate an outwardly directed pressure wave over a full 360° radiation angle in a plane transverse to a longitudinal axis of the downhole tubular (and that of the local expander device) in the expandable section. This results in an applied radial strain on the isolation joint within the expandable section.

The applied radial strain may exceed the elastic limit of the material from which the isolation joint tubular wall is made. The local plastic deformation inherently will cause thinning of parts of the wall that have been subjected to plastic deformation. However, the initially local thicker wall sections help to achieve that overall sufficient wall thickness is preserved post expansion or denting to maintain the required tubular pressure rating. Preferably, the initial wall thickness is selected such that the wall thickness in the circumferential band is within 90% to 105% of the wall thicknesses of the separator sections after locally expanding the band. More preferably, the remaining wall thickness is within 90% to 100% after locally expanding. A small amount of thinning may be compensated by using a somewhat higher yield strength material. Steel material properties of this isolation joint are preferably selected with a view on plastic steel deformation: high material ductility and fracture toughness, enabling a large radial deformation by means of explosives or otherwise.

Figure 5:
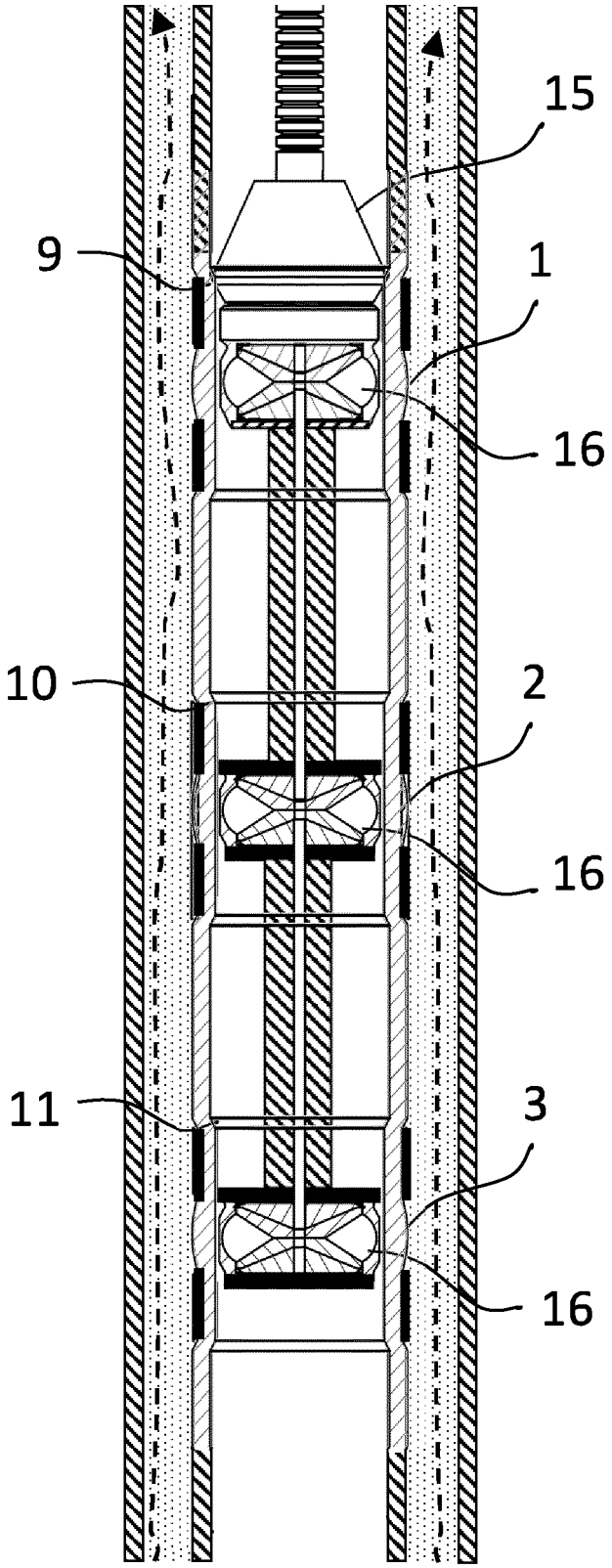
FIG. 5 schematically shows the cross-sectional view of the isolation joint of FIG. 4 which a multi-shot energetic expander landed in position.

After the operation, the local expander device 5 may be retracted, optionally unlatched, and relocated to a next expandable section, or, retrieved to surface. In the case of an energetic expander, at least the carrier section 15 of the local expander device 5 may be retrieved to surface. If necessary, the operation can be repeated in a next expandable section. Suitably, each subsequent shoulder (10, 11) in the isolation joint may have a slightly smaller inner diameter than the previous one, so that a subsequent local expander device 5 can be lowered into the well and land on the next shoulder. The carrier section 15 and the complementary mating support 29 may also be slightly smaller than in the previous run(s). Alternatively the distance between carrier section 15 and the force impacting section 16 is extended to land it across the next expandable section 22-23. Alternatively, a multi-expander may be employed, such as the multi-shot energetic expander as schematically depicted in FIG. 5, which aligns several force impacting sections with several expandable sections, simultaneously. Multi-shot energetic expander devices as such are described in e.g. U.S. Pat. No. 11,002,097.

Swellable elastomer sleeves 4 as shown in FIG. 1 are particularly recommended in combination with energetic expanders, as free water or oil tends to behave like an undeformable solid compared to water or oil absorbed in the elastomer material. Moreover, the presence of such material post expansion also helps to avoid reopening of or forming of new microannuli.

Adjacent separator sections preferably remain unexpanded when the force imparting section of the local expander device 5 is activated. This helps to maintain integrity of the non-thickened wall sections of the isolation joint, and it may help to maintain integrity of the mating support 9.

Figure 6:
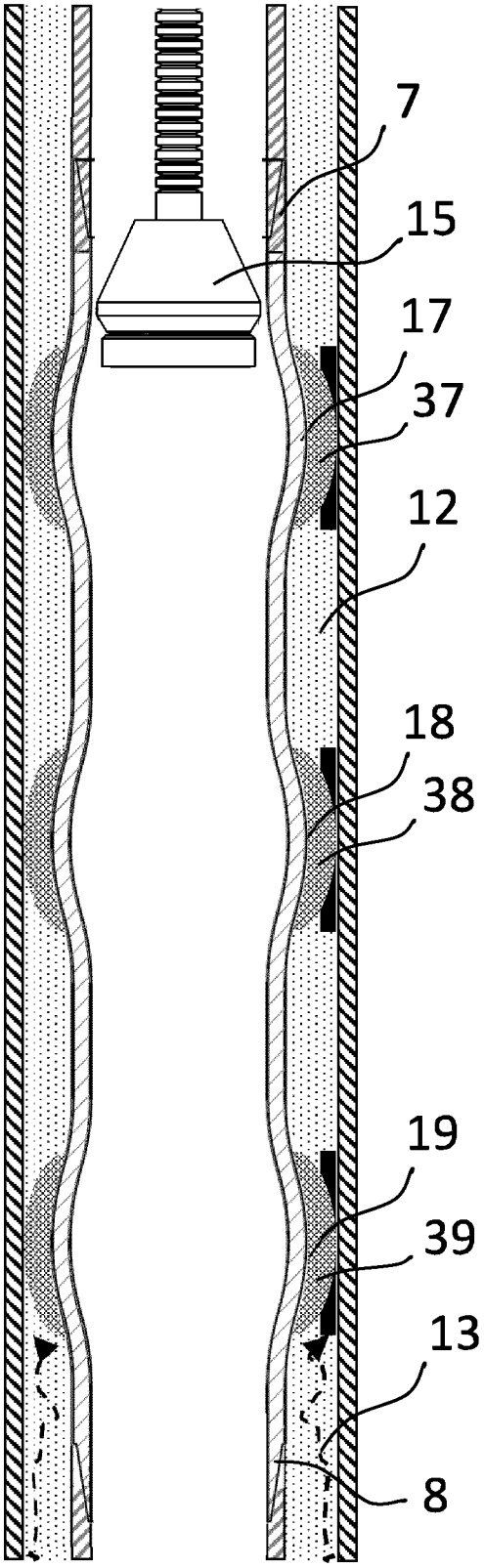
FIG. 6 schematically shows a cross-sectional view of the isolation joint of FIG. 4 subsequent to local expansion operation(s)

FIG. 6 schematically shows a cemented isolation joint with three locally expanded sections 17, 18, 19, optionally surrounded by swollen elastomeric material. Directly adjacent to the locally expanded sections 17, 18, 19 are impacted cement zones 37,38,39. It has been found in U.S. Pat. No. 10,794,158 and WO 2020/016169 A1 that well fluid seepages 13 to surface may effectively be blocked by such impacted cement zones 37,38,39.

Also illustrated is the carrier section 15 being retrieved to surface. The explosive charges 16 as disclosed in e.g. U.S. Pat. No. 11,002,097 are normally machined from steel parts and will break into smaller pieces post firing, leaving undesired debris behind in the wellbore. Such debris inside production wells may lead to blockages across downhole valves or flowline valves. To resolve this debris issue, it is proposed to manufacture the explosive housing and internal parts from dissolvable material. Such dissolvable material, which degrade downhole in interaction with a wellbore fluid, is commercially available for frac barriers and frac balls. Known dissolvable materials include dissolvable metals, such as TervAlloy 3241 (Trademark). Suitable information may be available in one or more of U.S. Pat. Nos. 9,903,010; 10,150,713; and 9,757,796.

Figure 7:
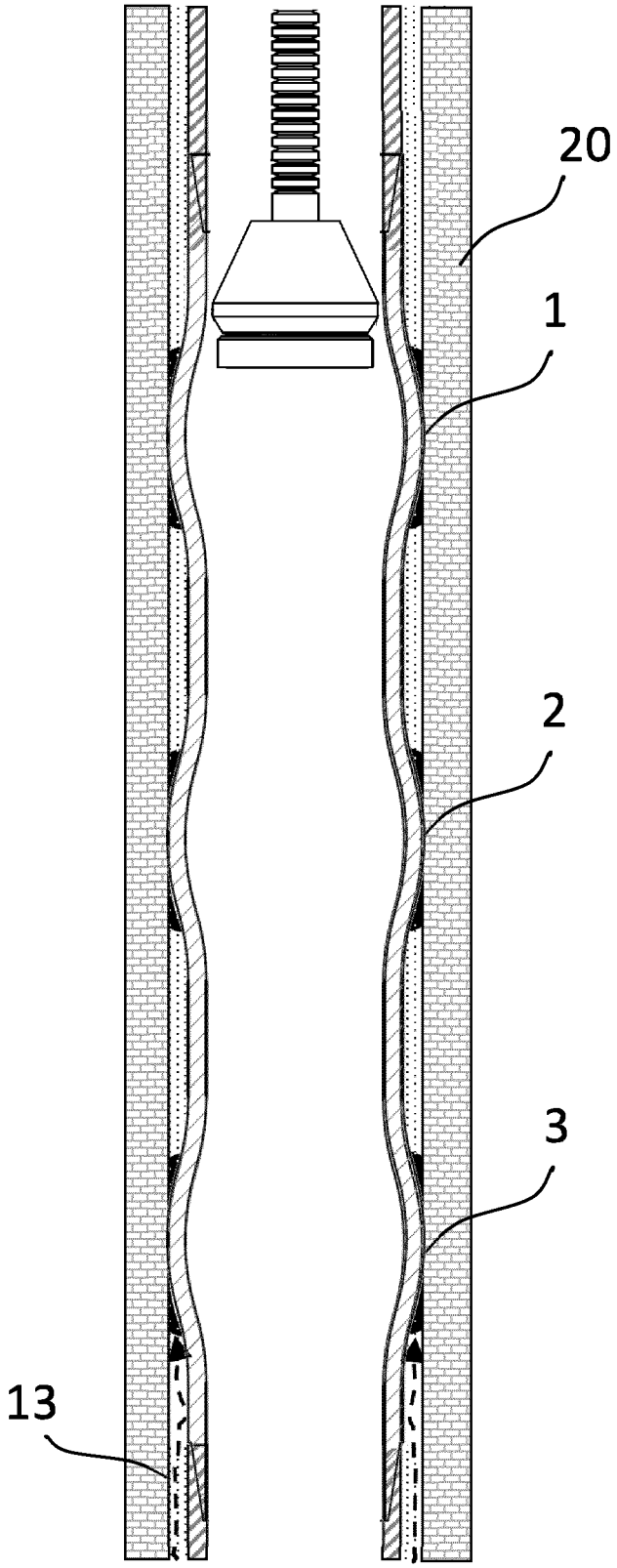
FIG. 7 schematically shows a cross-sectional view of the isolation joint of FIG. 4 subsequent to local expansion operation(s) in an open hole.

FIG. 7 schematically shows a cross-sectional view of the isolation joint of FIG. 4 subsequent to local expansion operation(s) in an open hole. The method may be applied in cemented and uncemented open hole. In this case, the seal is formed by the dents bridging across the entire annulus against the bore wall of rock formation 20. This may be applied with or without elastomeric material 4, and with or without gravel pack completion. The method may also be used to create a metal-to-metal seal by bridging an annulus to an outer casing or outer well tubular. Such applications may benefit from use of a soft metal, e.g. tin, copper or an elastic metal-to-metal seal design to account for elastic-spring back of the force imparting section 16.

Figure 8:
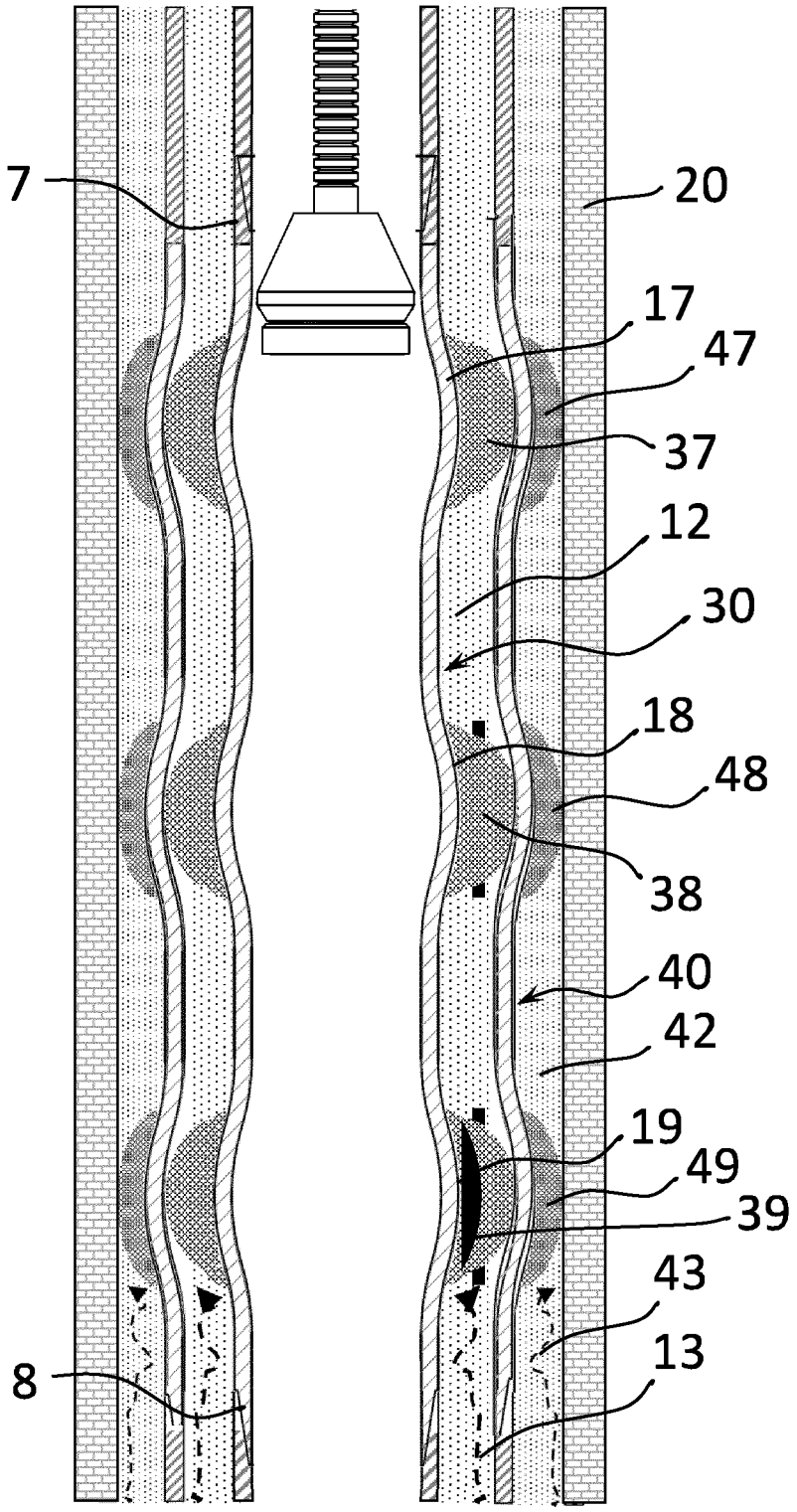
FIG. 8 schematically shows cross-sectional view of the isolation joint of FIG. 4 cemented within a surrounding tubular string, after local expansion.

FIG. 8 schematically shows cross-sectional view of the isolation joint 30 of FIG. 4 cemented within a surrounding tubular string 40, which in turn is cemented as well with a surrounding cement layer 42. The surrounding tubular string 40 may, for example, correspond to the outer casing 14 of FIG. 4, cemented in place within the surrounding rock formation 20 by the surrounding cement layer 42. The configuration is depicted after local expansion operation(s) of the three locally expanded sections 17, 18, 19. Facilitated by the bands of increased wall thickness in the expandable sections, the radial expansion can be so high that the surrounding tubular string 40 also undergoes local expansion as a result of the force being transferred to the surrounding tubular string 40 through the impacted cement zones 37,38,39. Even in absence of any elastomeric material on the surrounding tubular string the local expansion may cause affected zones 47,48,49 in the surrounding cement layer 42 as well, which can seal cavities and seepage paths 43 in a similar manner as disclosed in U.S. Pat. No. 10,794,158 and WO 2020/016169 A1.

Figure 9:
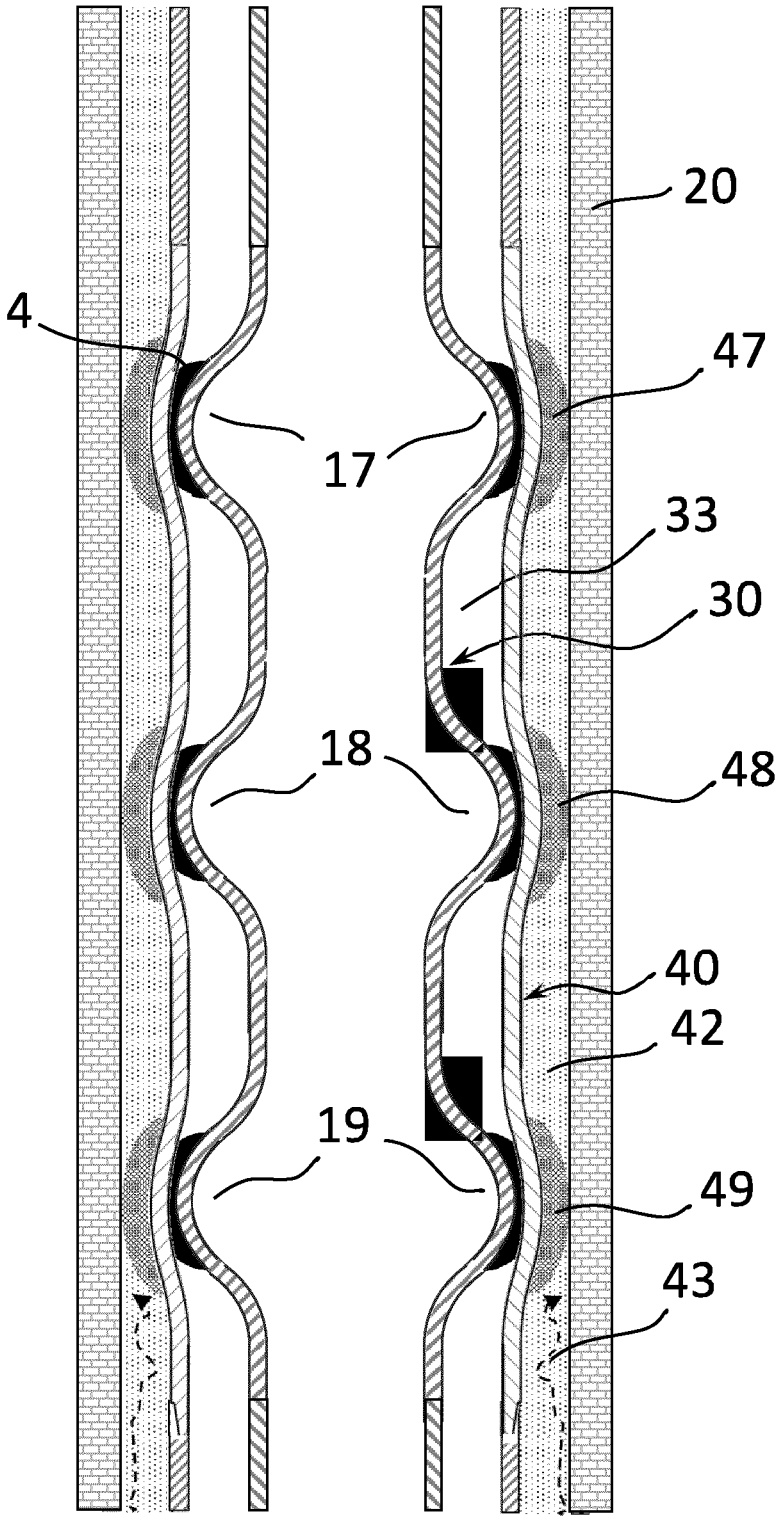
FIG. 9 schematically shows cross-sectional view of the isolation joint of FIG. 4 with an open annulus and a surrounding tubular string, after local expansion FIG. 10 schematically shows a cross-sectional view of the isolation joint of FIG. 1 provided with optional sacrificial rings.

FIG. 9 is similar as in FIG. 8, except that the annulus 33, which directly surrounds the isolation joint 30, is an open annulus (not cemented). In this example, the isolation joint might have been pre-emptively installed within a production tubing, for example. The surrounding cement layer 42 may, for example, seal off a B annulus below the casing. In case of a leak in the B annulus, the extended expansion ratio that is available in the expandable sections as proposed in the present invention can be used to bridge the entire open annulus 33 to the surrounding tubular string 40. This could be applied as a contingency against packer leaks in case they may occur. The radial expansion can optionally be so high that the surrounding tubular string 40 also undergoes local expansion outside of the expandable sections. Even in absence of any elastomeric material on the surrounding tubular string 40, the local expansion may cause affected zones 47,48,49 in the surrounding cement layer 42 which can seal cavities and seepages 43 in a similar manner as disclosed in U.S. Pat. No. 10,794,158 and WO 2020/016169 A1. The additional elastomeric seals 4 may be optionally provided. These could swell by absorption of fluids present in the open annulus 33, such as water, hydrocarbons, or carbon dioxide. The configuration of FIG. 9 may also be performed with and without a gravel pack completion.

Figure 11:
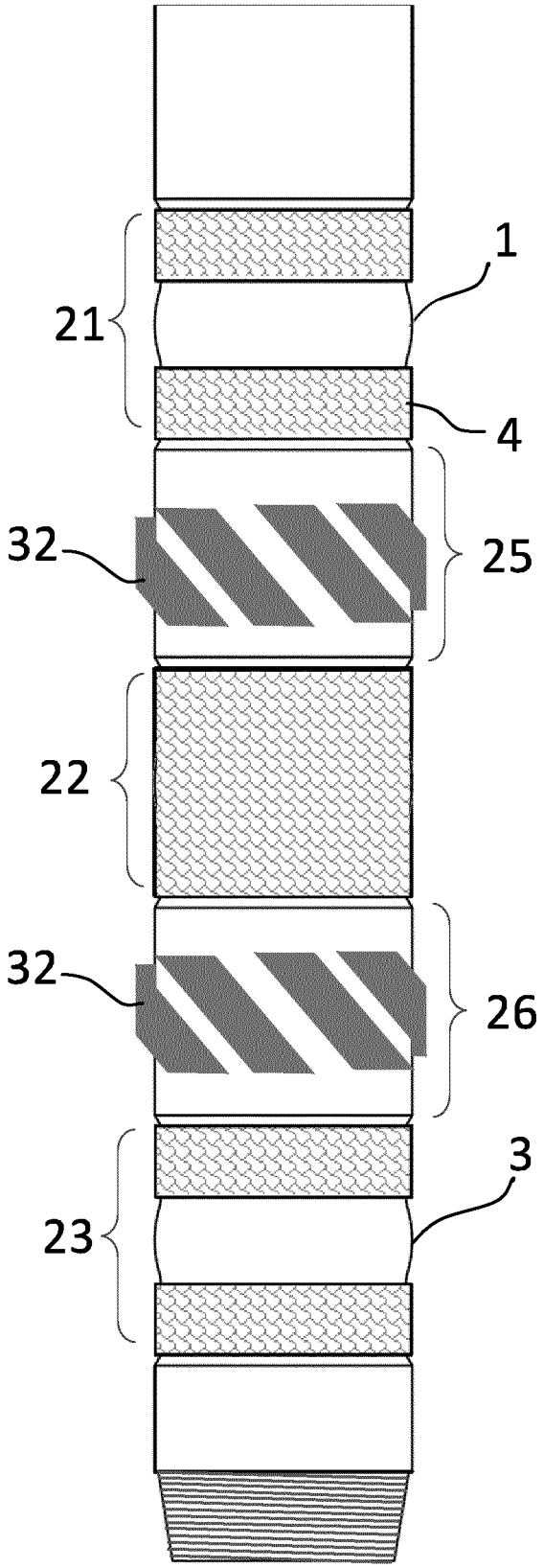
FIG. 11 schematically shows a side view of the isolation joint of FIG. 1 provided with optional centralizers.

The mating support(s) of the downhole tubular may comprise or consist of an insert part which, when inserted into position in the downhole tubular, locally reduces the inner diameter of the downhole tubular. Such insert part may preferably be manufactured from one or more dissolvable materials, which degrade downhole in interaction with a wellbore fluid. Known dissolvable materials include dissolvable metals, such as TervAlloy 3241 (Trademark). An example is shown in FIG. 11, where the insert part 31 is provided in the form of a ring which shoulders on any one of the landing shoulders 9, 10, 11. The inner diameter is significantly reduced by the ring, which is beneficial for centralizing the expander tool. The ring can be machined from dissolvable material, so that after dissolution a larger running clearance can be created, for example for subsequent tool runs.

Other designs of the insert part are possible. For example, the insert part may be a ring that shoulders on a small recess in the inner wall of the isolation joint, and spring into place. The dissolvable parts (e.g. ring) may replace the landing shoulder all together, leaving a flush inner wall of the tubular after the parts have dissolved, to preserve drift diameter.

Regardless of the design, a coating may be applied, to the delay the dissolution of the material if this is deemed necessary. Such delay would at least allow sufficient time between installation of the isolation joint in a borehole and the subsequent running of the expander tool.

The circumferential band of increased wall thickness, in any of the embodiments described herein, may extend over a length (in axial direction) of the tubular which is sufficient to accommodate multiple "dent areas" for dents that are neighboring each other in abutment. This way, circumferential dents can be set closer to each other (axially) than would be the case in a plain section of casing or other well tubular. Dent spacing down to between 0.5 and 1 meter may be achieved. A suitable tool with close dent spacing which may be used in combination with the isolation joint as described herein is the dual end firing explosive column tool which is described in e.g. US patent application publication No. 2021/0254423 A1. This tool employs a plurality of high explosive pellets along a central tube to form an explosive column.

One or more centralizers may optionally be provided on the isolation joint. As shown in FIG. 11, the separator sections 25, 26 are good places to apply centralizers 32. The separator sections 25, 26 are relatively close to the expandable sections 21,22,23 and thus give more certainty that the expandable sections are well centralized in the borehole. Proper centralization ensures that the expandable sections can expand uniformly around the entire circumference of the isolation joint, and when the isolation joint is cemented in place the centralization ensures that particularly around the expandable sections the cement layer is continuous and thus tight.

Preferably, the centralizers 32 are secured to the isolation joint to prevent them from sliding to the elastomeric seals in the expandable sections. While standard slip-on centralizers (straight vane or spiral vane) may be employed, it is preferred to employ centralizer solutions that are bonded directly to the wellbore tubular. Innovex, for example, markets WearSox (trademark) centralizers, which have free-standing blades and no connecting collars, and a concept named multi-layer composite centralizers (MCC) which are factory manufactured structural centralizers that are bonded directly to the tubular. Both WearSox and MCC can be glued to the wellbore tubular. MCC is available in both helical and straight blade configurations, and generally is smaller than most slip-on products and therefore a good choice given the axial length constraints that may exist in the separator sections. Alternatively, rubber vanes could be employed which may be volcanized to the isolation joint when the elastomeric seals are applied to the wellbore tubular.

Figure 12:
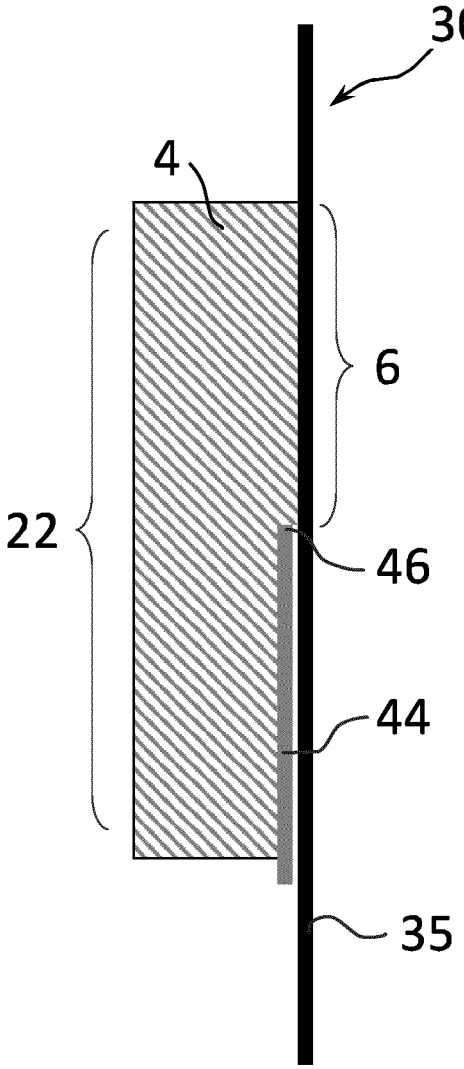
FIG. 12 schematically shows an detail cross sectional view of one side of an isolation joint with an elastomeric seal.
Figure 13:
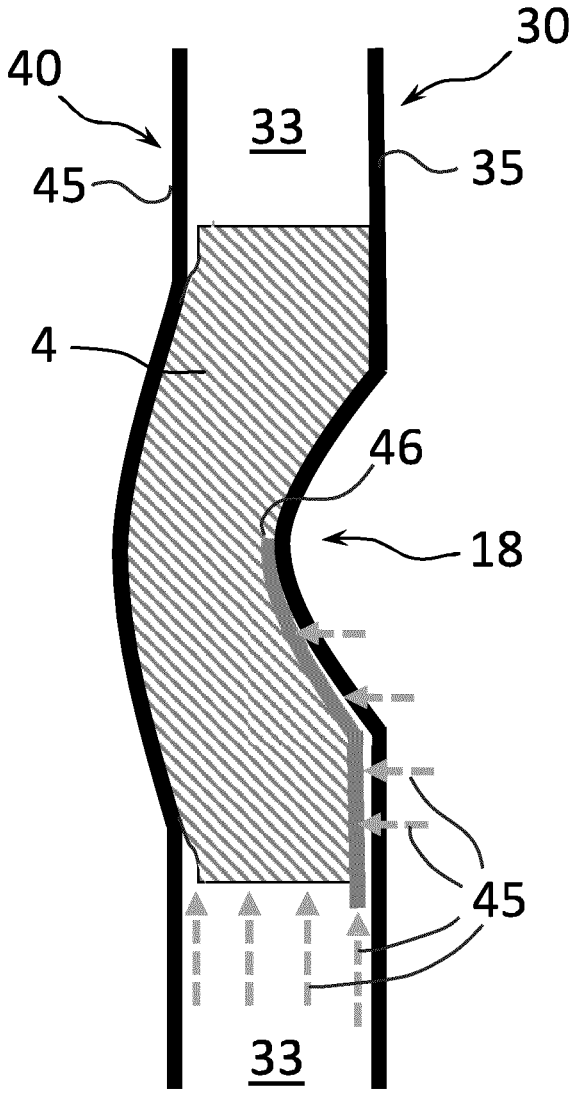
FIG. 13 schematically shows the detail of FIG. 12 subsequent to local expansion in a surrounding tubular string.

Elastomeric seals as described herein may be volcanized after they have been pre-installed on the isolation joint. The vulcanization also brings about a bonding to the outside surface of the isolation joint, which helps to keep the seals in place while running the isolation joint down hole. FIGS. 12 and 13 illustrate an embodiment wherein a self-energizing quality is provided on the elastomeric seal.

Starting with FIG. 12, a detailed cross section view is provided of one side of the isolation joint around an expandable section 22. A protective sleeve 44, preferably manufactured of a thin sheet of metal such as steel, is provided between the side wall 35 of the isolation joint 30 and the elastomeric seal 4. On one end (e.g. the lower end) of the elastomeric seal 4, the protective sleeve 44 extends at least to the edge of the elastomeric seal 4. It may stick out somewhat. On the other end, a significant length 6 of the elastomeric seal 4 is in direct contact with the outside wall 35 of the isolation joint 30. Upon vulcanization, the elastomeric seal 4 bonds to the outside wall 35 over the length 6, while the protective sleeve 44 prevents the elastomeric seal 4 to bond to the outside wall 35 over the remaining length of the elastomeric seal 4. Preferably, the elastomeric seal 4 bonds to the protective sleeve 44.

Turning now to FIG. 13, the same isolation joint 30 of FIG. 12 is shown after having been locally expanded in a surrounding tubular string 40. The force imparting section of the local expander device was configured in transverse alignment with a top rim 46 (or at least in the vicinity of the top rim 46) of the protective sleeve 44, so that the locally expanded section 18 partly overlaps with the protective sleeve 44. The elastomeric seal 4 is expanded into contact with the side wall 45 of the surrounding tubular string 40, to create a pressure seal in annulus 33. As the lower portion of the elastomeric seal 4 is not in contact with the outside wall 35 of the isolation joint 30, any fluid can creep between the protective sleeve 44 and the outside wall 35 of the isolation joint 30. The pressure 45 of such fluid can thus pressurize the elastomeric seal 4 against the inside of the side wall 45 of the surrounding tubular string 40. Herewith, an improved sealing against the surrounding tubular string 40 can be accomplished. Advantageously, the protective sleeve 44 is somewhat pliable to maximize the radially outward force that the fluid pressure 45 can exert on the side wall 45 through the elastomeric seal 4. For example, the protective sleeve 44 may be provided as a knitted mesh, or a steel sleeve with narrow longitudinal slits.

In respect of any of the embodiments described hereinabove, in operation, prior to running the local expander device, a casing collar locator (CCL) tool may be run in any of the embodiments described herein. The CCL may form part of a drift tool string, and can be utilized to verify the precise location of the isolation joint. This reduces the risk of landing the local expander device on a casing restriction which is not the intended mating support, and locally expanding the wellbore tubular at a wrong depth (i.e. outside of the intended expandable section). The wall thickness variation profile (in axial direction) of the isolation joint described herein can be identified on a CCL-log with high degree of certainty.

In any of the embodiments described herein, instead of running the local expander tool on a line, it is contemplated that the local expander tool may be pre-installed in the isolation joint and run in the hole together with the isolation joint as part of the casing/tubing run. Although cement could be pumped across if needed, this option may be most attractive when the annular sealing relies on the local expansions of the isolation joint only. Particularly when an energetic expander (including multi-shot or explosive column) is used, it may be equipped with a firing head which can detonate the charges or pellets via a pressure pulse sequence from surface or on a timer. Also in this case, it is advantageous to employ dissolvable metals (and/or other dissolvable materials) where possible, so that the tool and/or debris will drop to the rathole in the bottom of the well.

It is thus apparent that the methodology may be applied to isolation joints in tubular strings, such as production strings, cemented completion strings, liner hanger overlap, or placed across open hole as part of a lower completion. The isolation joint described herein may also be run as a liner hanger packer system or liner tie back sealing arrangement, run and installed using methods as described herein. The methods, devices, systems, isolation joints and combinations thereof as described herein may be suitably applied in any type of borehole in the Earth, including hydrocarbon fluid production wellbores and carbon dioxide storage wells.

The person skilled in the art will understand that the present invention can be carried out in many various ways without departing from the scope of the appended claims.

I claim:

1. A method of creating an annular zonal isolation seal in a downhole annulus between a string of downhole tubular joints inserted within a bore in a borehole in the Earth, and an inner wall of the bore, comprising:

providing an isolation joint in the string, the isolation joint having a first separator, a second separator, and a circumferential band of increased wall thickness, wherein the circumferential band of increased wall thickness is sandwiched in an axial direction between the first separator and the second separator, and the wall thickness of the circumferential band of increased wall thickness is greater than the wall thicknesses of the first separator and the second separator, providing a mating support at a predetermined axial location relative to the circumferential band of increased wall thickness, the mating support adapted for mating with a local expander device within said downhole tubular;

lowering the local expander device through the downhole tubular string and at least partially into the isolation joint, the local expander device comprising:

a force imparting section configured to impart a transversely directed expansion force to the circumferential band of increased wall thickness, and a carrier section, carrying the force imparting section, and comprising a complementary mating support at a predetermined axial separation distance relative to the force imparting section for engaging the mating support transversely aligning the force imparting section of the local expander device with the circumferential band of increased wall thickness; and activating the force imparting section of the local expander device to impart a radial strain on the isolation joint exclusively on the circumferential band of increased wall thickness, thereby locally expanding the downhole tubular in the downhole annulus;

wherein the circumferential band of increased wall thickness is formed as a unitary single-piece.

2. The method of claim 1, wherein the first separator and the second separator remain unexpanded when the force imparting section of the local expander device is activated.

3. The method of claim 1, further comprising:

retrieving at least the carrier section of the local expander device to surface.

4. The method of claim 1, wherein the wall thickness of the circumferential band of increased wall thickness is at least 15% thicker than the wall thicknesses of the first separator and the second separator.

5. The method of claim 1, wherein the wall thickness of the circumferential band of increased wall thickness is from 90% to 105% of the wall thicknesses of the first separator and the second separator after the activating step.

6. The method of claim 1, wherein the mating support is located in the first separator or the second separator of the isolation joint.

7. The method of claim 1, wherein the mating support comprises a landing surface on a shoulder that is inwardly protruding into the isolation joint and wherein the carrier section engages the mating support comprises landing the complementary mating support on the landing surface.

8. The method of claim 1, further comprising an elastomeric seal arranged on a circumference of an outwardly facing side of the isolation joint.

9. The method of claim 8, wherein the elastomeric seal is arranged at least in the circumferential band of increased wall thickness.

10. The method of claim 1, wherein the force imparting section comprises explosive charges and wherein activating the force imparting section comprises detonation of the explosive charges.

11. The method of claim 10, wherein the explosive charges generate an outwardly directed pressure wave over a full 360° radiation angle in a plane transverse to a longitudinal axis of the circumferential band of increased wall thickness.

12. The method of claim 10, wherein the force imparting section is manufactured from one or more dissolvable materials that degrade downhole in interaction with a wellbore fluid.

* * * * *